US009988180B2

(12) United States Patent
Ogburn

(10) Patent No.: US 9,988,180 B2
(45) Date of Patent: Jun. 5, 2018

(54) PALLET

(75) Inventor: Sean T. Ogburn, Hoschton, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 2494 days.

(21) Appl. No.: 12/016,987

(22) Filed: Jan. 18, 2008

(65) Prior Publication Data

US 2009/0183655 A1 Jul. 23, 2009

(51) Int. Cl.
*B65D 19/00* (2006.01)

(52) U.S. Cl.
CPC ..... *B65D 19/0016* (2013.01); *B65D 2519/00034* (2013.01); *B65D 2519/00069* (2013.01); *B65D 2519/00273* (2013.01); *B65D 2519/00288* (2013.01); *B65D 2519/00333* (2013.01); *B65D 2519/00407* (2013.01); *B65D 2519/00562* (2013.01)

(58) Field of Classification Search
CPC ..... B65D 2519/00273; B65D 2519/00562; B65D 2519/00552; B65D 2519/00034; B65D 2519/00069; B65D 2519/00174; B65D 2519/00208; B65D 2519/00243
USPC .... 29/525.14, 897, 897.31, 527.1, 799, 238; 108/51.11–57.34
See application file for complete search history.

(56) References Cited

U.S. PATENT DOCUMENTS 5,520,121 A * 5/1996 Schubert et al. ..... 108/57.1
5,778,801 A * 7/1998 Delacour ..... 108/57.25
5,806,436 A * 9/1998 Weichenrieder et al. . 108/57.23
6,352,039 B1 3/2002 Woods et al.
6,955,129 B2 * 10/2005 Moore et al. ..... 108/57.25
2003/0106470 A1 * 6/2003 Apps et al. ..... 108/57.25
2005/0145145 A1 * 7/2005 Ogburn et al. ..... 108/57.25
2005/0252424 A1 * 11/2005 Apps ..... 108/57.25
2006/0032413 A1 * 2/2006 Ogburn et al. ..... 108/57.25
2007/0028813 A1 * 2/2007 Hassell ..... 108/51.11
2008/0017081 A1 * 1/2008 Baltz ..... 108/56.1
2009/0050029 A1 * 2/2009 Ogburn ..... 108/51.11

FOREIGN PATENT DOCUMENTS

GB 2 272 203 5/1994
WO 84/01932 A 5/1984
WO 00/68100 A 11/2000
WO 2006/014857 A 2/2006
WO 2006/089242 A 8/2006

OTHER PUBLICATIONS

European Search Report for EP Application No. 09150650.1, dated Jun. 16, 2009.

* cited by examiner

*Primary Examiner* — Christopher M Koehler
(74) *Attorney, Agent, or Firm* — Carlson, Gaskey & Olds PC

(57) ABSTRACT

A pallet has an upper deck portion having an upper planar portion and a lower deck portion having a lower planar portion. Ribs extend from one of the planar portions and are vibration welded to the other planar portion. A peripheral lip extends downwardly from the upper deck portion around the periphery of the lower portion. In this manner, the entire upper deck portion, which includes the entire upper surface of the pallet, is vibration welded to the lower deck portion. Further, the peripheral lip of the upper deck portion hides any flash that might be generated by the vibration welding process.

21 Claims, 10 Drawing Sheets

PALLET

BACKGROUND OF THE INVENTION

This invention relates to a pallet for storing or transporting goods.

Pallets are often used to store and transport goods. The pallets maintain the goods at a distance above the floor such that they can be readily lifted and moved by a fork of a lift truck.

Many different designs of plastic pallets are well known. One known plastic pallet includes an upper deck portion having an upper planar portion with ribs extending downwardly therefrom. A lower deck portion includes a lower planar portion having ribs extending upwardly therefrom. The upper ribs are secured to the lower ribs via hot plate welding.

SUMMARY OF THE INVENTION

The present invention provides a pallet having an upper deck portion having an upper planar portion and a lower deck portion having a lower planar portion. Ribs extend from one of the planar portions and are vibration welded to the other planar portion. A peripheral lip extends downwardly from the upper deck portion around the periphery of the lower portion.

In this manner, the entire upper deck portion, which includes the entire upper surface of the pallet, is vibration welded to the lower deck portion. Further, the peripheral lip of the upper deck portion hides any flash that might be generated by the vibration welding process.

A lower deck portion may include integrally molded columns extending downwardly as well as runners extending therebetween. The lower deck portion may include a peripheral wall around the periphery of the pallet, having a recess at an upper exterior edge thereof for accommodating flashing generated by the vibration welding process.

These and other features of the application can be best understood from the following specification and drawings, the following of which is a brief description.

DETAILED DESCRIPTION OF THE PREFERRED EMBODIMENT

Figure 1:
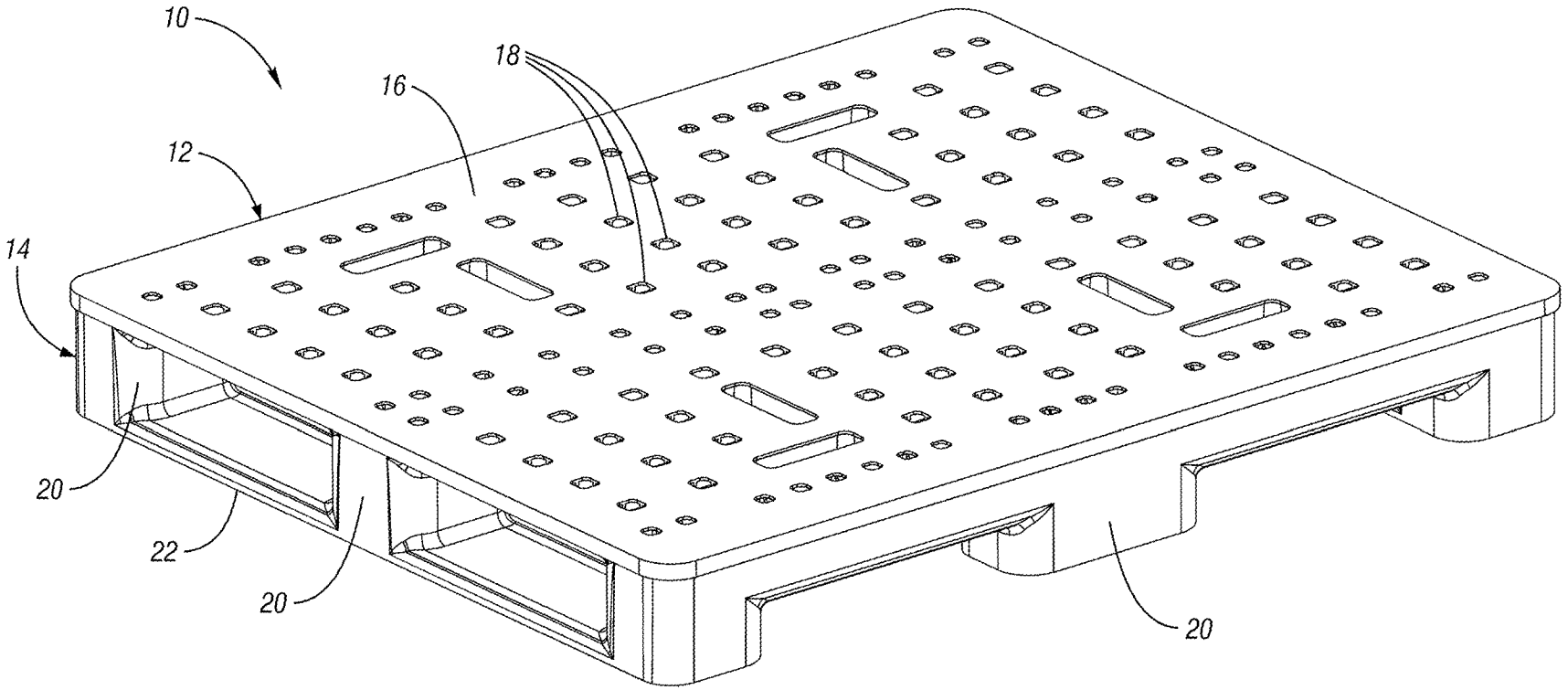
FIG. 1 is a perspective view of a pallet according to one embodiment of the present invention.

A pallet 10 according to one embodiment of the present invention is shown in FIG. 1. The pallet 10 includes an upper deck portion 12 secured to a lower deck portion 14. The upper deck portion 12 includes an upper planar portion 16, which provides the entire upper surface of the pallet 10. Openings 18 through the upper planar portion 16 reduce weight and provide drainage and ventilation.

The lower deck portion 14 includes a plurality of columns 20 extending downwardly and integrally molded therewith. The lower deck portion 14 further includes runners 22 extending between lower ends of the columns 20.

Figure 2:
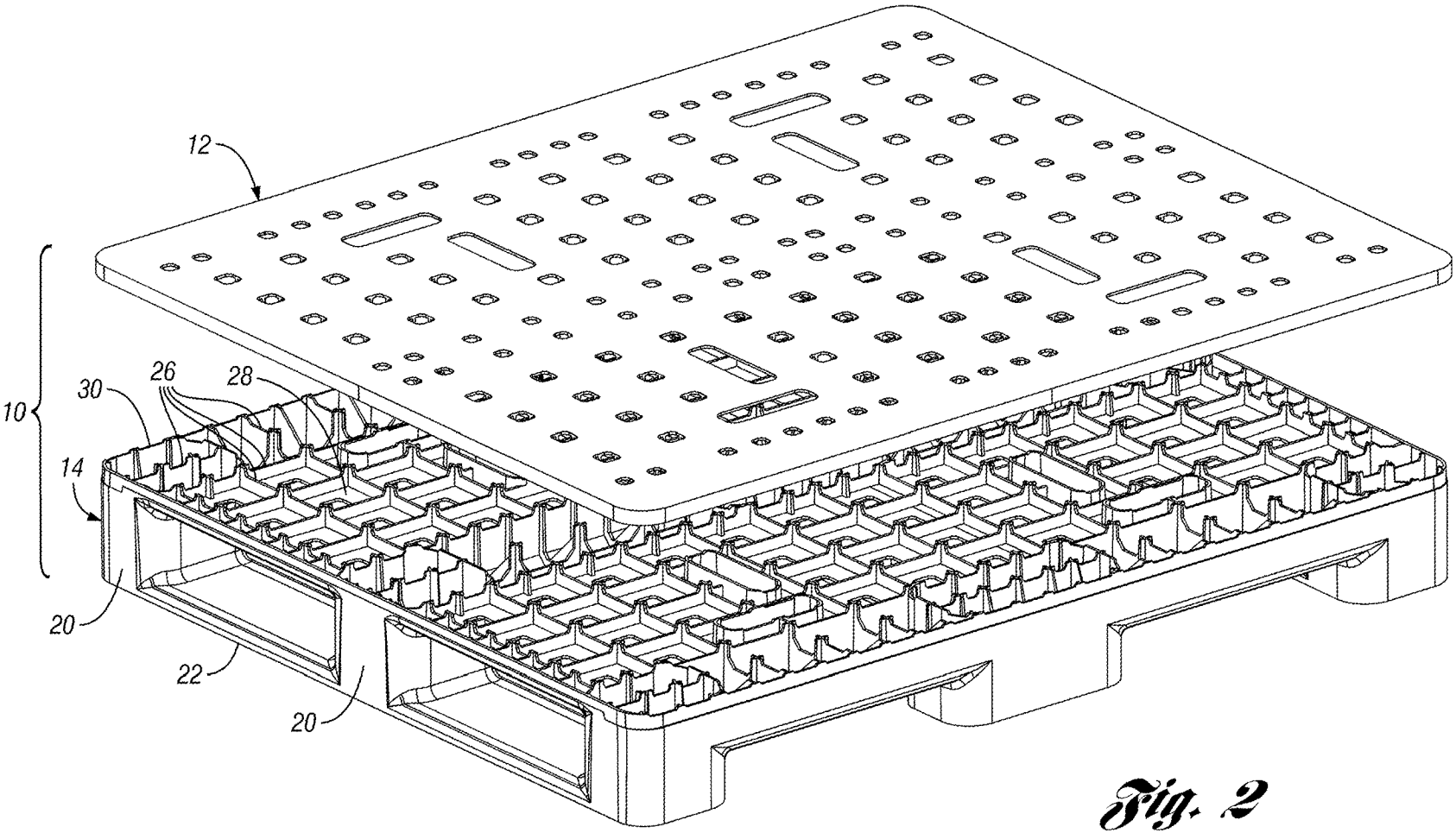
FIG. 2 is an exploded view of the pallet of FIG. 1.

FIG. 2 is an exploded view of the pallet 10. As shown, the lower deck portion 14 further includes a lower planar portion 28 having a plurality of transversely intersecting ribs 26 extending upwardly therefrom. The lower deck portion 14 further includes a peripheral wall 30 extending around the periphery of the lower deck portion 14.

Figure 3:
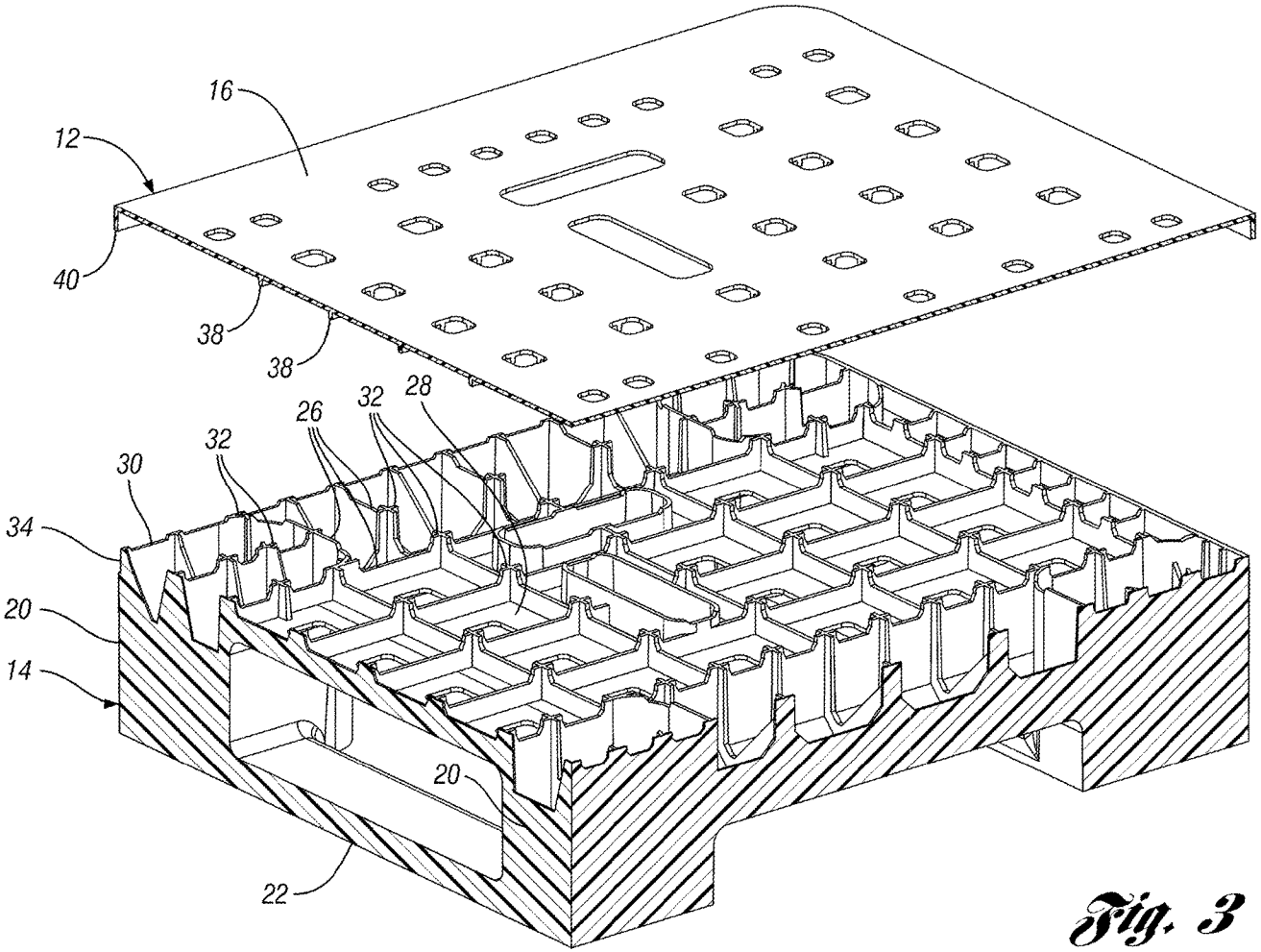
FIG. 3 is an enlarged exploded view of a quarter of the pallet of FIG. 2.
Figure 3A:
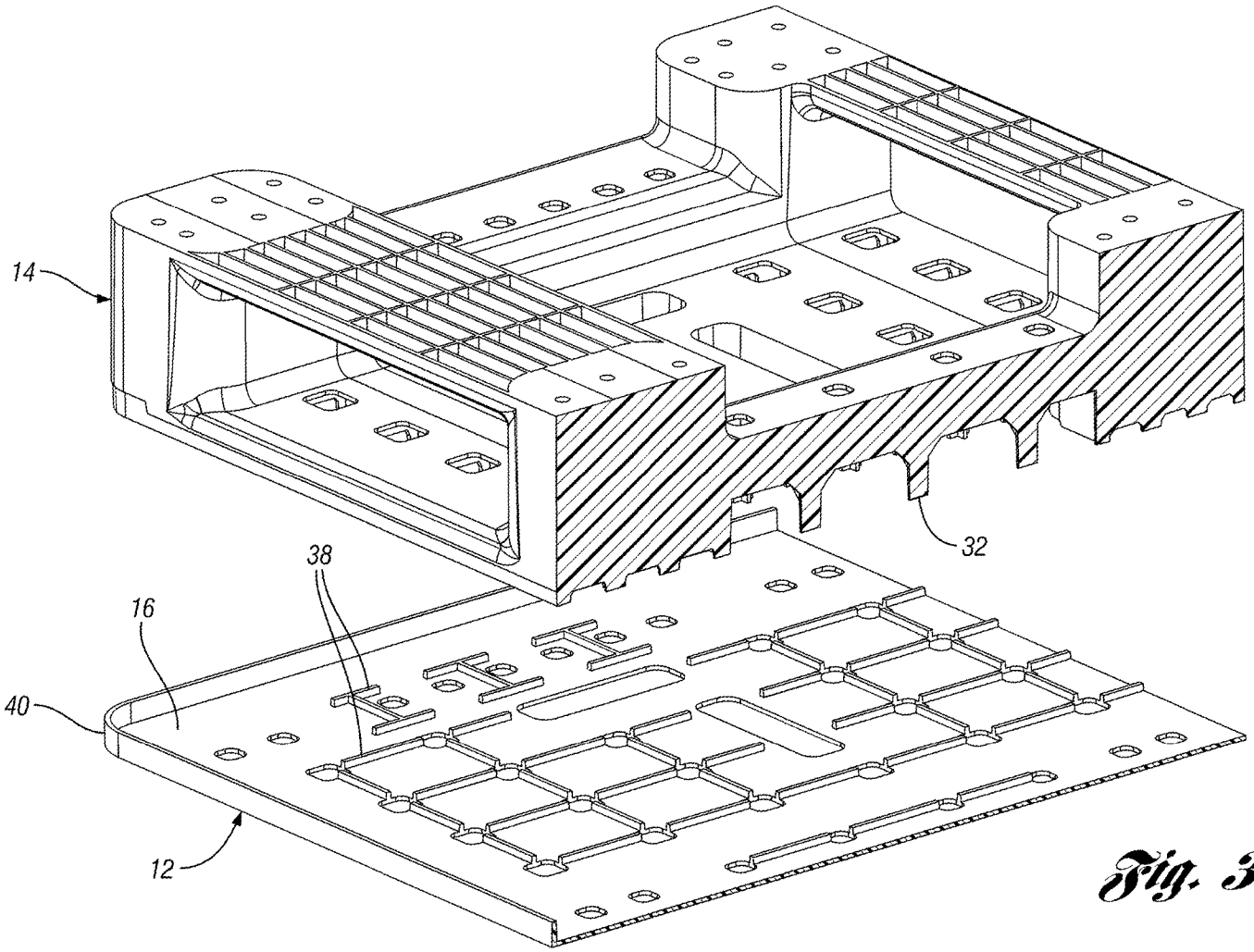
FIG. 3A is a bottom perspective exploded view of the quarter of the pallet of FIG. 3.

FIG. 3 is an exploded perspective view of a quarter of the pallet 10 of FIG. 2 (only a quarter is shown, so that more detail is visible, the symmetry of the pallet 10 is evident from FIGS. 1 and 2). FIG. 3A is a bottom perspective view of the quarter of the pallet 10 of FIG. 3. Referring to FIGS. 3 and 3A, the intersecting ribs 26 include a plurality of protruding mating portions 32 protruding therefrom. In particular, the mating portions 32 are formed at the intersections of the ribs 26. The upper exterior surface of the peripheral wall 30 includes a slight recess 34.

The upper deck portion 12 includes integral reinforcing ribs 38 protruding downward from the upper planar portion 16. An integral peripheral lip 40 extends downward from the periphery of the upper planar portion 16.

Figure 4:
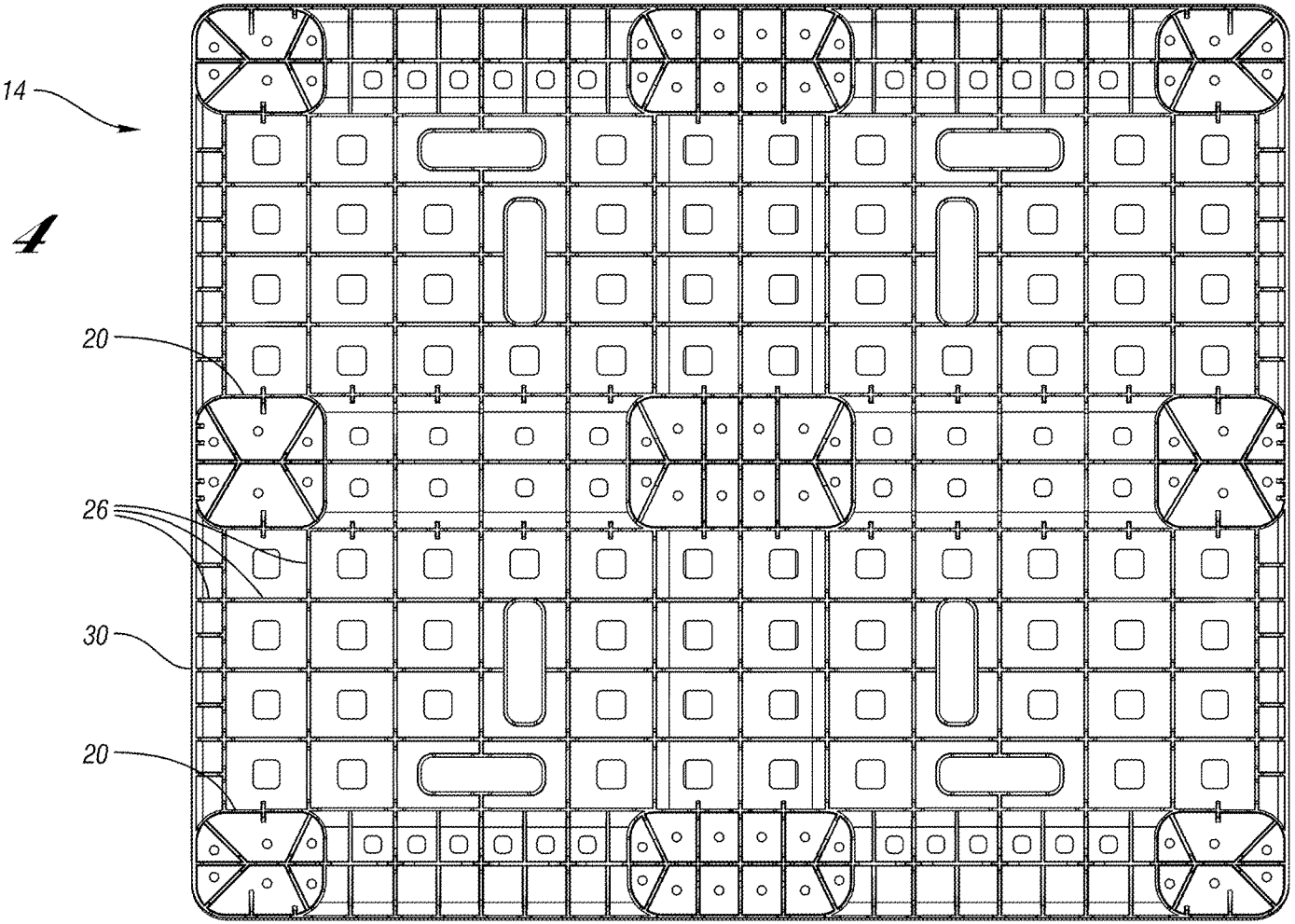
FIG. 4 is a top view of the bottom deck portion of FIG. 2.

FIG. 4 is a top view of the bottom deck portion 14. As shown, the ribs 26 intersect the columns 20 and peripheral wall 30 and extend through the columns 20.

Figure 5:
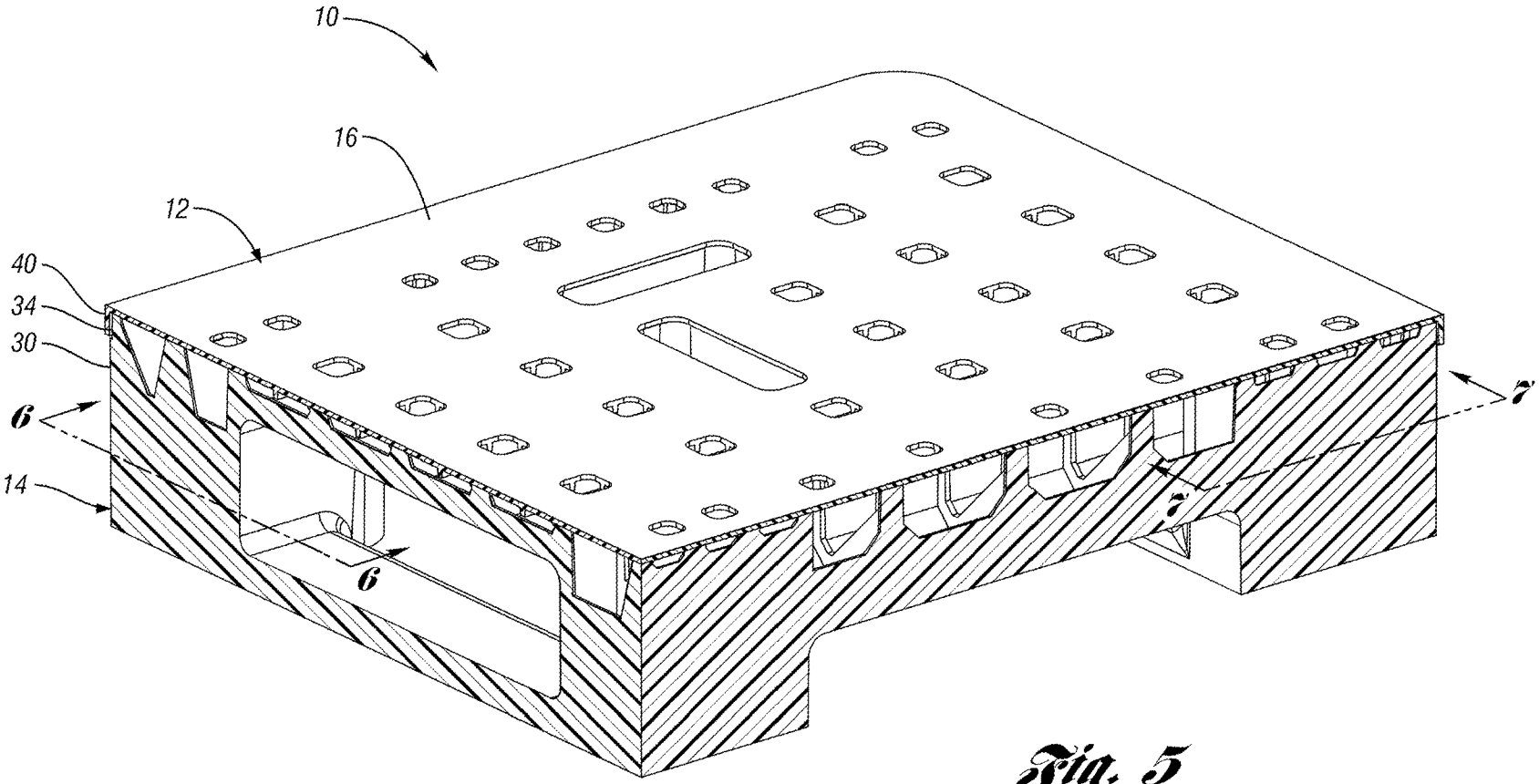
FIG. 5 is a perspective view of a quarter of the pallet of FIG. 1.

FIG. 5 is a perspective view of the quarter of the pallet 10 in an assembled condition. As shown, when assembled, the peripheral lip 40 of the upper deck portion 12 covers at least a substantial portion of the recess 34 in the peripheral wall 30.

Figure 6:
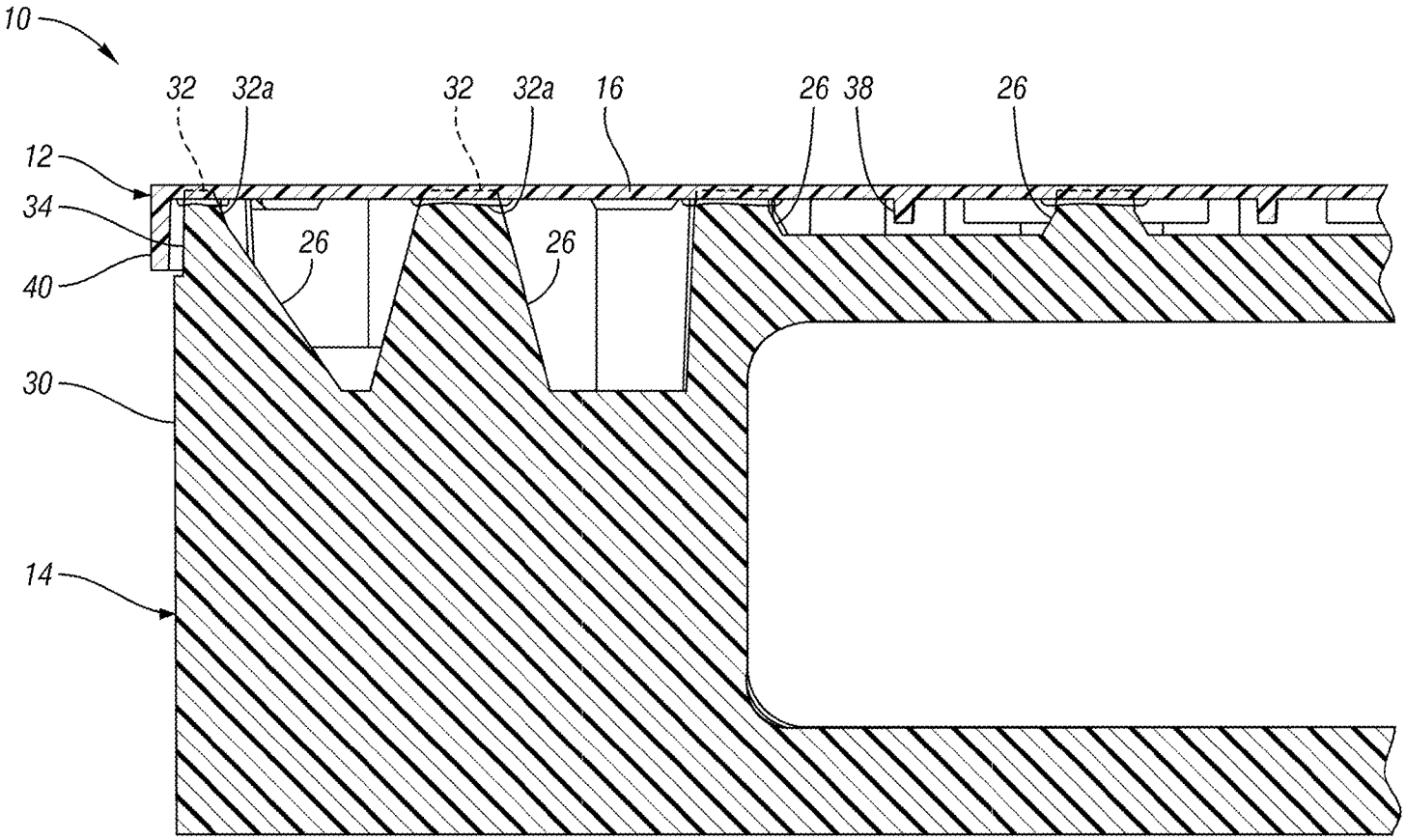
FIG. 6 is a section view of the pallet taken along lines 6-6 of FIG. 5.
Figure 7:
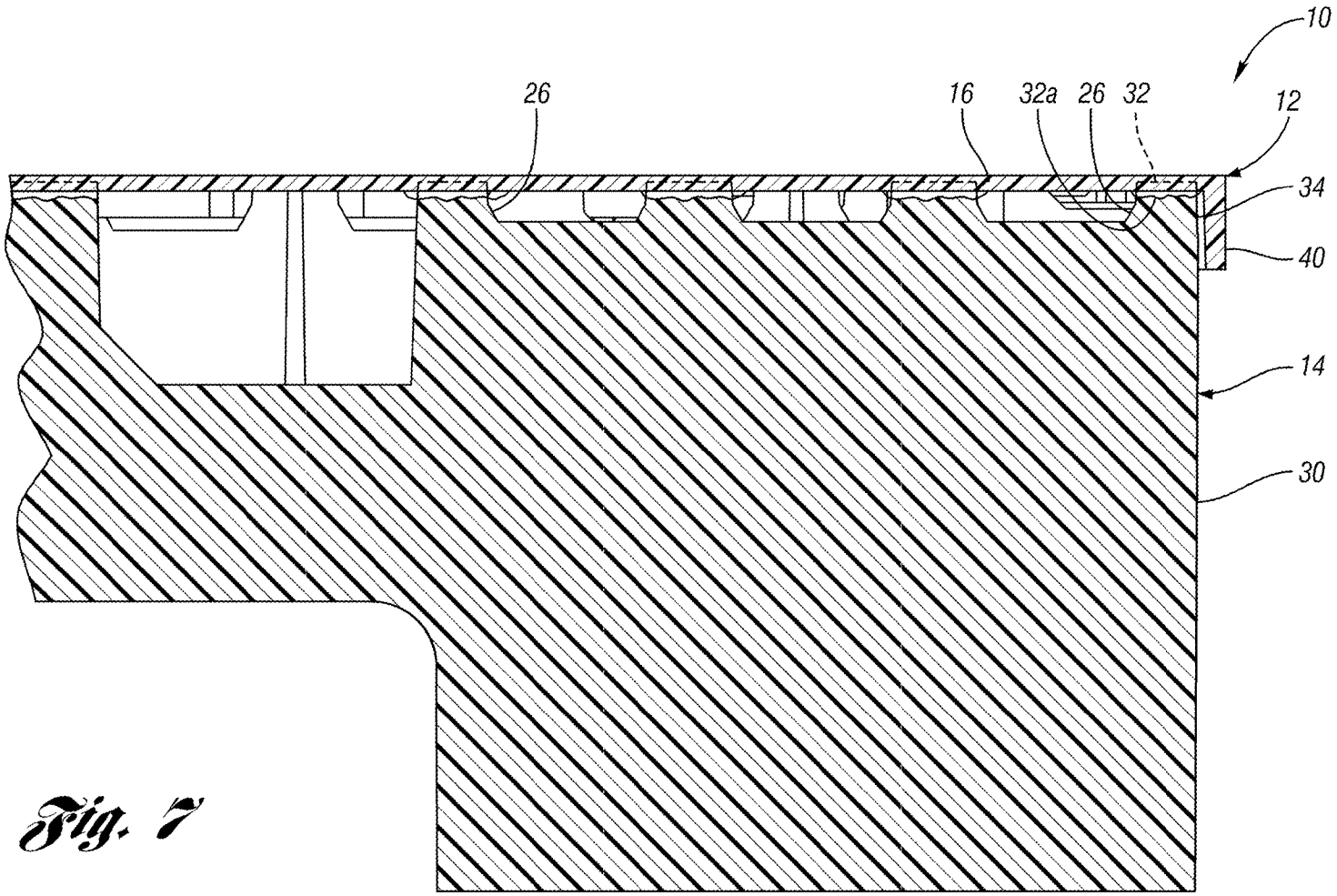
FIG. 7 is a section view through the pallet of FIG. 1 taken along lines 7-7 of FIG. 5.

FIGS. 6 and 7 are section views taken along line 6-6 and 7-7 of FIG. 5, respectively (note that FIG. 5, showing a quarter of the pallet 10, is already sectioned and broken away along those lines). As shown, the mating portions 32 (shown in phantom) are melted during a vibration welding process to connect the mating portions 32 to the upper planar portion 16 of the upper deck portion 12. The melted mating portions form a weld bead and flashing 32*a*, which secures the upper planar portion 16 to the ribs 26. Some of the flashing 32*a* flows into the recess 34 on the exterior of the peripheral wall 30 and is hidden from view by the peripheral lip 40 of the upper deck portion 12. Note that the recess 34 is deeper in FIG. 6 than in FIG. 7 and extends downwardly further in FIG. 6 than in FIG. 7. This indicates the direction of the relative movement between the upper deck portion 12 and lower deck portion 14 during the vibration welding process. The portion of the recess 34 in FIG. 6 accommodates the relative motion and accommodates some flashing 32*a*, while the portion of the recess 34 in FIG. 7 only provides some minimal clearance for parallel movement of the parts and accommodates some amount of flashing 32*a*.

Also referring to FIG. 6, the reinforcing ribs 38 on the upper deck portion 12 extend downward between adjacent ribs 26 but are not secured to the lower deck portion 14.

Figure 8:
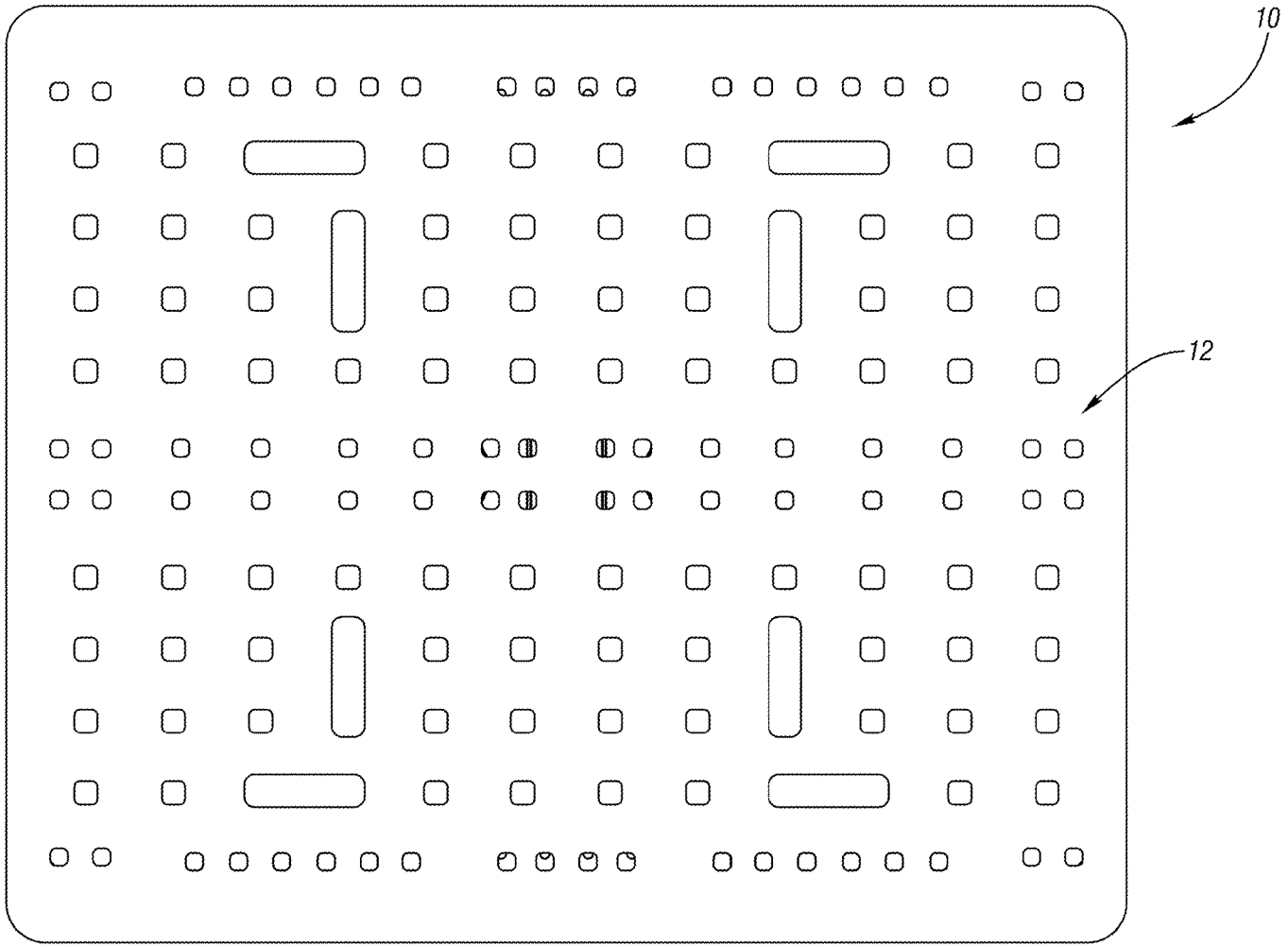
FIG. 8 is a top view of the pallet of FIG. 1.
Figure 9:
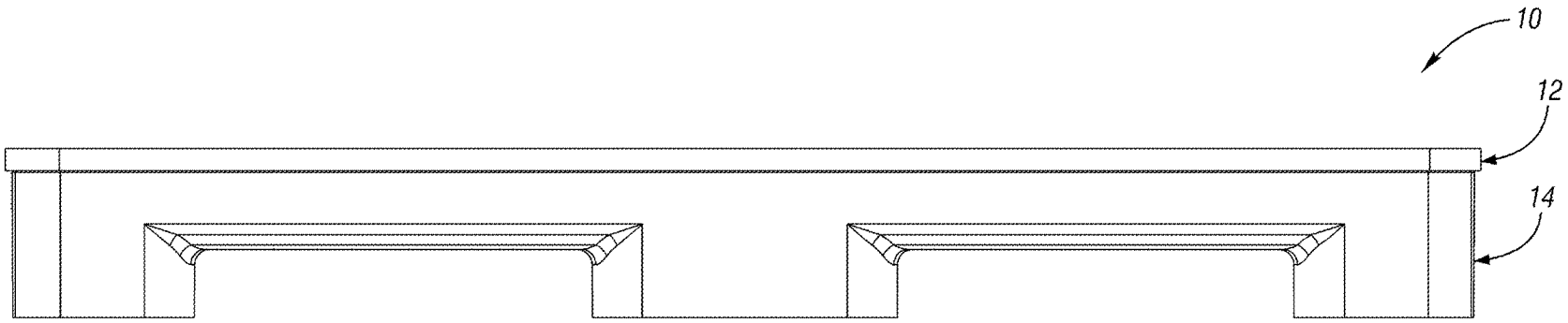
FIG. 9 is a front view of the pallet of FIG. 1.
Figure 10:
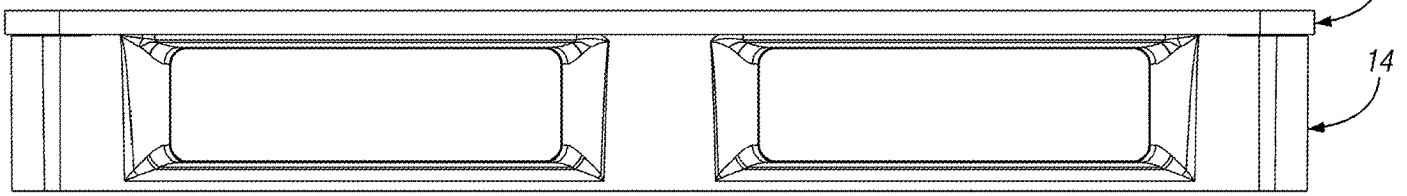
FIG. 10 is a side view of the pallet of FIG. 1.

FIG. 8 is a top view of the pallet 10. FIG. 9 is a front view of the pallet 10. FIG. 10 is a side view of the pallet 10.

In the example embodiment, the upper deck portion 12 is integrally molded as a single part from a thermoplastic material via injection molding. Similarly, the example lower deck portion 14 is integrally molded as a single part from a thermoplastic material via injection molding.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method steps are for convenient reference in dependent claims and do not signify a required sequence of performance unless otherwise indicated in the claims.

What is claimed is:

1. A method for manufacturing a pallet including the steps of:

a) forming a lower deck portion having a lower planar portion, a peripheral wall of the lower deck portion having a recess at an upper exterior surface thereof;

b) forming an upper deck portion having a upper planar portion, a peripheral lip protruding downwardly from a periphery of the upper planar portion, one of the upper planar portion and the lower planar portion including a plurality of transversely intersecting ribs and a plurality of mating portions protruding from the plurality of intersecting ribs, wherein the lower deck portion is integrally molded as a single part, and wherein the upper deck portion is integrally molded as a single part;

c) placing the upper deck portion on the lower deck portion, with the peripheral wall of the lower deck portion within the peripheral lip of the upper deck portion; and d) vibration welding the mating portions of the ribs to the other of the upper planar portion and the lower planar portion.

2. The method of claim 1 wherein the plurality of intersecting ribs are integrally molded with the lower deck portion.

3. The method of claim 1 wherein the lower deck portion further includes columns extending downward from the lower deck portion and integrally molded with the lower deck portion.

4. The method of claim 3 wherein the lower deck portion further includes integrally molded runners extending between lower ends of the columns.

5. The method of claim 1 wherein said steps a) and b) are performed by injection molding.

6. The method of claim 2 wherein the upper deck portion further includes reinforcing ribs extending downwardly therefrom, the method further including the step of placing the reinforcing ribs between adjacent pairs of the plurality of ribs of the lower deck section.

7. The method of claim 1 further including the step of: e) accommodating flashing generated by the vibration welding of step d) in the recess.

8. The method of claim 7 wherein said step e) further includes the step of accommodating the flashing behind the peripheral lip.

9. The method of claim 8 wherein the lower deck portion further includes a plurality of columns extending downward from the lower planar portion, wherein the plurality of columns are integrally molded with the lower planar portion.

10. The method of claim 8 wherein the lower deck portion further includes a plurality of columns extending downward from the lower deck portion, the peripheral wall extending about the plurality of columns.

11. The method of claim 10 wherein the plurality of columns are integrally molded with the lower planar portion.

12. The method of claim 8 wherein the lower deck portion further includes a plurality of columns extending downward from the lower planar portion, the peripheral wall extending about the lower planar portion.

13. The method of claim 12 wherein the plurality of columns are integrally molded with the lower planar portion.

14. The method of claim 12 wherein the recess extends adjacent the plurality of columns.

15. The method of claim 14 wherein the recess extends about the plurality of columns.

16. The method of claim 1 wherein the peripheral wall of the lower deck portion has the recess formed in an exterior surface thereof.

17. The method of claim 1 wherein the plurality of intersecting ribs and the mating portions are integrally molded with the lower planar portion, and wherein the mating portions are melted to the upper planar portion during the vibration welding step.

18. The method of claim 11 wherein the pallet consists of the single part providing the lower deck section and the single part providing the upper deck section.

19. A method for manufacturing a pallet including the steps of:

a) forming a lower deck portion having a lower planar portion and a plurality of columns extending downward from the lower planar portion, the plurality of columns integrally molded with the lower planar portion, a peripheral wall of the lower deck portion extending upward from the lower planar portion about the periphery of the lower planar portion, the peripheral wall having a recess at an upper exterior surface thereof;

b) forming an upper deck portion having a upper planar portion, a peripheral lip protruding downwardly from a periphery of the upper planar portion, one of the upper planar portion and the lower planar portion including a plurality of transversely intersecting ribs and a plurality of mating portions protruding from the plurality of intersecting ribs, wherein the lower deck portion is integrally molded as a single part, and wherein the upper deck portion is integrally molded as a single part;

c) placing the upper deck portion on the lower deck portion, with the recess of the peripheral wall of the lower deck portion within the peripheral lip of the upper deck portion; and d) vibration welding the mating portions of the ribs to the other of the upper planar portion and the lower planar portion, such that flashing from the vibration welding is received in the recess behind the peripheral lip.

20. The method of claim 19 wherein the plurality of intersecting ribs and the mating portions are integrally molded with the lower planar portion, and wherein the mating portions are melted to the upper planar portion during the vibration welding step.

21. The method of claim 19 wherein the pallet consists of the single part providing the lower deck section and the single part providing the upper deck section.

* * * * *